United States Patent [19]

Dunn, Jr. et al.

[11] 4,223,883

[45] Sep. 23, 1980

[54] BAG TUBE-FEEDER SYSTEM

[75] Inventors: Edward C. Dunn, Jr., Bogalusa, La.; Louis S. Hickman, Antioch, Calif.; Thomas D. Penny, Bogalusa, La.

[73] Assignee: Chase Bag Company, Greenwich, Conn.

[21] Appl. No.: 917,033

[22] Filed: Jun. 19, 1978

[51] Int. Cl.[3] ..... B65H 5/08

[52] U.S. Cl. ..... 271/11

[58] Field of Search ..... 271/3.1, 11, 12, 90–92, 271/30 R

[56] References Cited

U.S. PATENT DOCUMENTS

| | | | |
|---|---|---|---|
| 2,230,089 | 1/1941 | Potdevin | 271/12 |
| 2,941,799 | 6/1960 | Reincke | 271/92 |
| 3,522,943 | 8/1970 | Swanson | 271/3.1 X |

*Primary Examiner*—Richard A. Schacher

*Attorney, Agent, or Firm*—Jacobs & Jacobs

[57] ABSTRACT

A feeder system for serially feeding collapsed bag tubes including a first conveyor means for conveying a stack of tubes to a predetermined pickup location, second conveyor means spaced from the first conveyor means and feeder means disposed adjacent to the pickup location and between the first and second conveyor means for sequentially engaging the topmost tube in the stack and feeding it to the second conveyor means. The feeder means comprises a plurality of reciprocal picker arms and a pair of nip defining rotatable feeder elements disposed adjacent to the picker arms. The picker arms are adapted to serially transport the tubes from the top of the stack toward the nip defined by the rotatable feeder elements. The rotation of the rotatable feeder elements propels the tubes through the nip toward the second conveyor.

1 Claim, 3 Drawing Figures

BAG TUBE-FEEDER SYSTEM

FIELD OF THE INVENTION

This invention relates to a system for serially feeding collapsed bag tubes and has particular application to the feeding of open-ended bag tubes from a multiwall tuber machine to a sewing machine which sews shut one end of the tube. The system includes a feature which renders it particularly useful for feeding gusseted bags.

SUMMARY AND OBJECTS OF THE INVENTION

In the multiwall bag industry the sewn-open-mouth (SOM) style of bag has been a very popular type of bag, however, manufacture of SOM bags has been somewhat labor intensive.

A typical configuration of an SOM bag line consists of a tuber machine which delivers shingled tubes into an accomulator which groups the tubes into stacks or "hands". These tube stacks travel down a conveyor belt which passes in front of feeder equipment which transfers the bags into the sewing machines to complete the manufacture of the SOM bag. Existing feeder equipment has been somewhat unsatisfactory because of its complexity and failure to attain the running speeds desirable in a high speed SOM bag manufacturing operation. Further, existing feeder equipment requires manual transfer of tubes from the infeed conveyor belt and stacking of same on the feeders. Additionally, existing feeders are often a source of down time due to "jam-ups" caused by misfed tubes. Gusseted multiwall bags particularly have caused problems in this regard.

It is therefore an object of the present invention to provide a feeder system for bag tubes which is of simple and inexpensive construction.

It is another object of the present invention to provide a feeder system for bag tubes which performs the feeding function without manual assistance and in a speedy manner.

It is yet another object of the present invention to provide a bag tube feeder system readily adapted to the feeding of gusseted bags.

These objects have been attained in accordance with the present invention by providing a first conveyor means for conveying a stack of collapsed tubes to a predetermined pickup location. The first conveyor is inclined and the stack of tubes has the edges thereof positioned against a stop plate. Feeder means is disposed adjacent to the pickup location for sequentially engaging the topmost tube in the stack and feeding it to a second conveyor means. The feeder means comprises a plurality of picker arms disposed at substantially right angles to the first conveyor and reciprocatable along a unilinear path of movement to serially transport the tubes from the top of the stack toward rotatable feeder elements which periodically define a nip. At least one of the feeder elements comprises a wheel segment having a curved surface periodically defining a nip with the other rotatable feeder element. The reciprocal picker arms are positioned with respect to the path of movement of the wheel segment whereby each tube transported by the picker arms is positioned so that a portion of the tube intersects the circular path of movement of the wheel segment and is engaged thereby prior to formation of the nip with the other rotatable feeder element.

Other objects will become apparent from the following more detailed description and accompanying drawings in which:

DETAILED DESCRIPTION

Figure 1:
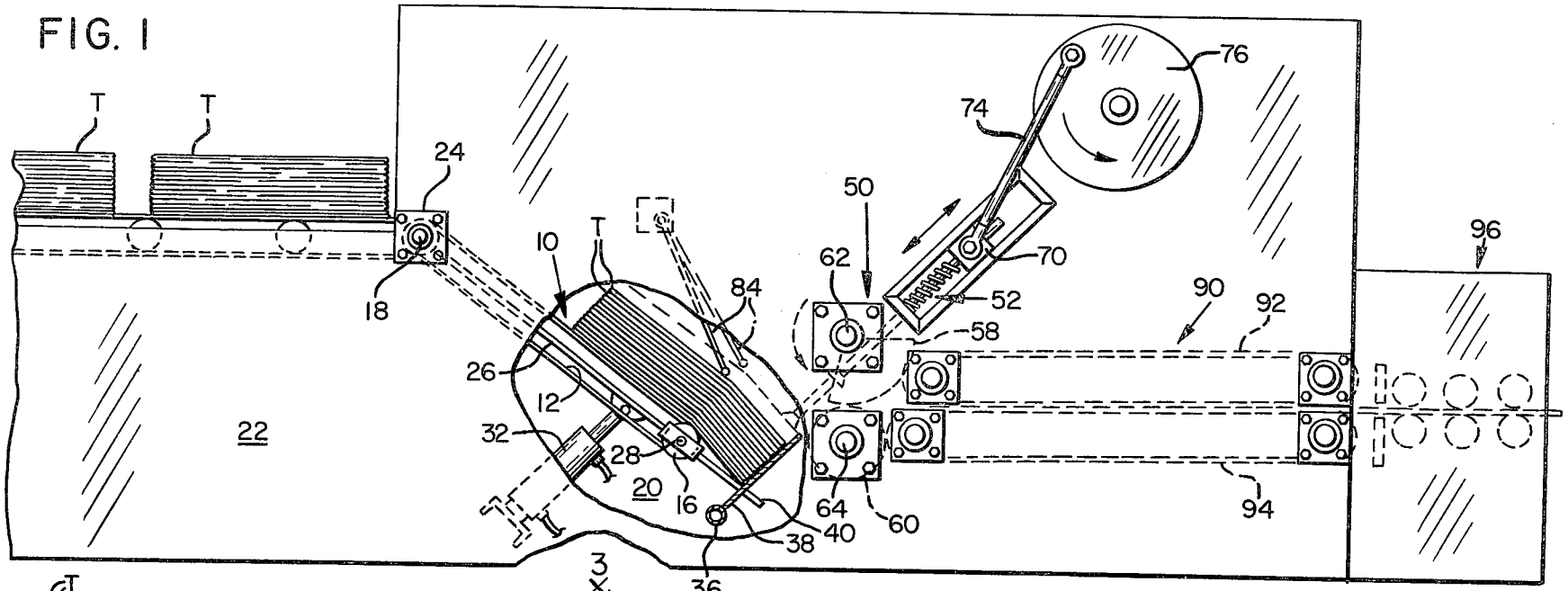
FIG. 1 is a side view in elevation, partially broken away, of apparatus constructed in accordance with the teachings of the present invention.

Referring now to the Figures, feeder apparatus constructed according to the present invention is illustrated in a typical working environment. Specifically, the feeder is illustrated as being employed in a manufacturing line for sewn-open-mouth (SOM) bags. The feeder apparatus includes a first conveyor means designated generally by reference numeral 10 and including an endless conveyor belt 12 inclined with respect to the horizontal and disposed about rollers 14 and 16. Roller 14 is mounted on a rotatable shaft 18 which extends between side walls 20 and 22 of the apparatus and is mounted on bearings in said walls such as bearing 24. Pivotally attached to shaft 18 in any suitable manner is a support plate 26 centrally disposed within conveyor belt 12 and parallel thereto. Roller 16 is attached to support plate 26 by means of a shaft 28 extending through the roller and shaft support brackets 30 attached to the plate near the end thereof. A pneumatic lift cylinder 32 is disposed under support plate 26 and connected thereto in such a manner as to pivotally move the first conveyor about shaft 18 upon actuation of the lift cylinder.

Extending between side walls 20 and 22 and attached thereto in any desired fashion as by welding is a bar or rod 36 to which are attached and extend upwardly therefrom spaced stop plates 38. Support plate 26 is bifuracted at the ends 40 thereof so that the support plate 26 may pass through and freely move with respect to stop plates 38. A stack or "hand" of collapsed tubes T are illustrated in FIGS. 1 and 2 as being positioned against stop plates 38.

Disposed adjacent to the tube pickup location defined by first conveyor means 10 and stop plates 38 is a feeder means designated generally by reference numeral 50. Feeder means 50 comprises a plurality of reciprocal picker arms 52 and a pair of nip defining rotatable feeder elements 58 and 60. Feeder element 58 comprises a segment of a wheel and feeder element 60 comprises a complete roller or wheel. Elements 58 and 60 are affixed to drive shafts 62 and 64, respectively, and are driven through a suitable gear arrangement 65 connected to a prime mover (not shown) so that rotation of the feeder elements 58 and 60 in the direction shown by the arrows in FIG. 2 results in the feeder elements periodically defining a nip.

Figure 2:
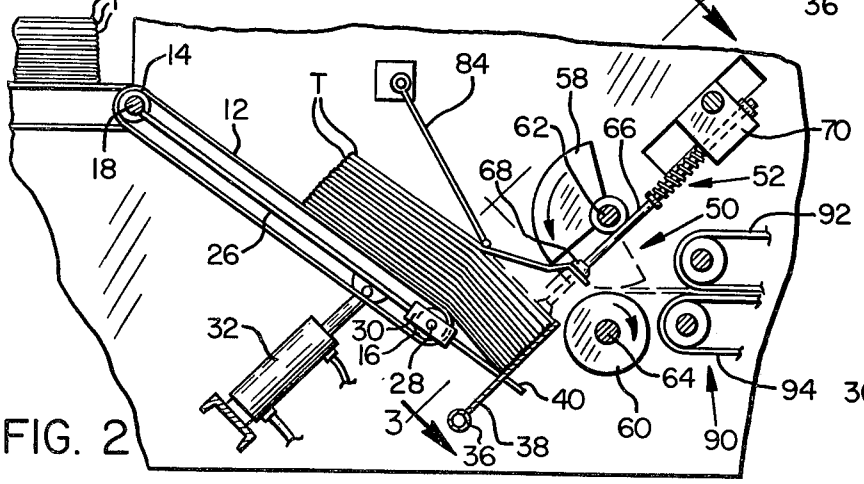
FIG. 2 is an enlarged side view in elevation of selected portions of the feeder apparatus.

Picker arms 52 are reciprocatably movable between the solid line position shown in FIG. 2 to the broken line position shown in that figure along a unilinear path which is adapted to serially deliver tubes from the top of the stack and deliver same to a location where wheel segment 58 may engage same and propel the tube being transported through the nip defined by feeder elements 58 and 60. Since the picker arms move along a unilinear path tube transport may be accomplished more simply and faster than in known prior art devices which often employ picker arms moving along a multi-directional path. Each picker arm 52 comprises a rigid hollow conduit 66 having a suction cup 68 disposed at the bottom thereof. The interiors of the conduits 66 and suction cups 68 are in communication with a suitable vacuum source (not shown). Conduits 66 are slidably movable within support blocks 70, said blocks being mounted on a common shaft 72. A crank mechanism including a crank arm 74 and a drive wheel 76 serves to cause reciprocatable movement of shaft 72, support blocks 70, and picker arms 52 in the direction shown by the arrow of FIG. 1 upon rotation of drive wheel 76. Downward movement of picker arms 52 brings the suction cups 68 thereof into contact with the topmost tube T in the stack positioned against stop plates 38. The conduits 66 of the picker arms are biased in a downwardly direction by means of compression springs 78 disposed between support blocks 70 and collars 80 adjustably secured to conduits 66 as by means of set screws. This arrangement avoids the necessity of precisely preadjusting the positions of the picker arms. Collars 82 are adjustably secured to conduits 66 at the tops thereof for adjustment purposes.

It will be appreciated that movement of the feeder elements 58 and 60 is coordinated with the reciprocal movement of picker arms 52 through any desired expedient such as direct gear connection, chain drive, etc. Such interconnection has not been shown since it is readily within the purview of one skilled in the art and forms no part of the present invention. Likewise, a suitable valving arrangement will be employed to connect the interiors of conduits 66 with a suitable source of vacuum so that vacuum is applied to the interior of suction cups 68 at the proper stages of operation of the feeder device. Again, such valving has not been shown since such apparatus is well-known in the art and it forms no part of the present invention.

The apparatus according to the present invention operates as follows. First, a stack of bag tubes T is positioned in the pickup location defined by stop plates 38 upon actuation of first conveyor means 10. An automatic control will preferably be employed to stop movement of the first conveyor means when the tubes reach the stop plates. The pneumatic cylinder 32 lowers the free end of first conveyor means 10 relative to stop plates 38 so that the topmost tube T is located a suitable distance away from picker arms 52 when such arms are in the solid line retracted position shown in FIG. 2. Preferably, pneumatic cylinder 32 has associated therewith a control mechanism of automatically indexing the pneumatic cylinder to raise first conveyor means 10 automatically as the stack of tubes T is depleted during the feeding operation. Automatic indexing arrangements of the aforedescribed type are known in the bag feeder and placement art and will not be described in detail. Suffice it to say that in the embodiment of the invention shown, a sensing are 84 rides on the topmost tube T and through a suitable servo interconnect causes air cylinder 32 to move first conveyor means 10 upwardly as the stack of tubes T is diminished.

To feed the topmost tube T off the stack the picker arms 52 move downwardly so that vaccum cups 68 thereof are in engagement with the topmost tube T. Vacuum is then applied to the picker arms and the arms move upwardly from the dotted line position shown in FIG. 2 to the solid line position shown in that figure. Movement of the picker arms 52 is timed relative to movement of wheel segment 58 so that a portion of the tube intersects the circular path of wheel segment 58 prior to the wheel segment forming a nip with the other rotatable feeder element 60. This is best shown in FIG. 2. Engagement of the tube T by wheel segment 58 propels the end of the tube toward the nip location. Preferably, the outer curved surface of the wheel segment 58 is knurled or otherwise roughened to ensure positive engagement of the tube T with the wheel segment 58. It will be appreciated that vacuum is removed from the suction cups 68 just prior to engagement of the tube T by the wheel segment 58 so that forward movement of the tube T will not be impeded. Once the nip is formed between feeder elements 58 and 60, the tube T engaged by the nip and continued rotational movement of the feeder elements propels the tube through the nip toward a second conveyor means generally designated by reference numeral 90. In the illustrated embodiment second conveyor means 90 comprises two belt conveyors 92 and 94 which are disposed in face to face relationship. Movement of the belt conveyors 92 and 94 further transports the tube T to the sewing station 96.

As previously stated, the apparatus according to the present invention is particularly useful for the feeding of gusseted bags. It will be appreciated that such bags are disposed against stop plates 38 when the tubes T are in the illustrated infeed position. Because the bag edges are in effect "pinched" by the feeder elements 58 and 60 upon engagement with and feeding thereby, the gussets of the bag will be positively maintained in a closed position and will not have a tendency to open. In prior art systems the feeding of gusseted bags has caused some difficulties since the gussets tend to open when conveyed and have a tendency to jam the feeder equipment.

Figure 3:
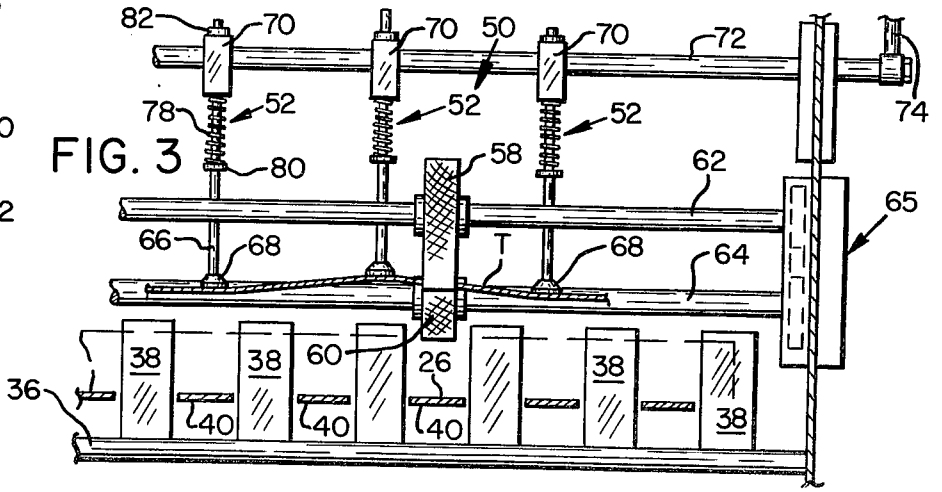
FIG. 3 is a sectional view taken along the line 3—3 of FIG. 2 but with a stack of tubes removed for clarity.

As previously noted, the positions of vacuum cups 68 of the picker arms 52 may be varied through adjustments of collars 80 and 82. As may best be seen in FIG. 3, it is preferred that the lower ends of the outermost picker arms be disposed below the end of the centrally disposed picker arm during transport of a tube so that the tube assumes a generally V-shaped configuration. This "break" in the bag tube adds strength to the tube while it is being fed.

We claim:

1. A method of serially feeding collapsed bag tubes comprising:

disposing a stack of collapsed bag tubes in an inclined position;

serially removing the topmost tubes from said stack and transporting at least a portion thereof along a unilinear path of motion;

disposing at least two feeder elements so that at least one of said feeder elements is positioned along said linear path of motion;

rotating said feeder elements;

periodically forming a nip between said rotating feeder elements;

engaging the tube being transported with at least one of said rotating elements prior to formation of said nip; and passing said tube between said rotating feeder elements during formation of said nip.

* * * * *

UNITED STATES PATENT AND TRADEMARK OFFICE

CERTIFICATE OF CORRECTION

PATENT NO. : 4,223,883

DATED : September 23, 1980

INVENTOR(S) : EDWARD C. DUNN, JR., LOUIS S. HICKMAN AND THOMAS D. PENNY

It is certified that error appears in the above-identified patent and that said Letters Patent are hereby corrected as shown below:

COLUMN 3, line 51, change "of" to --- for ---;

line 58, change "are" to --- arm ---;

line 62, after "off" insert --- of ---;

line 63, change "vaccum" to --- vacuum ---

Signed and Sealed this

Fourteenth Day of April 1981

[SEAL]

Attest:

RENE D. TEGTMEYER

Attesting Officer

Acting Commissioner of Patents and Trademarks